US006183077B1

(12) United States Patent
Hmelar et al.

(10) Patent No.: US 6,183,077 B1
(45) Date of Patent: Feb. 6, 2001

(54) METHOD AND APPARATUS FOR KEYING INK SUPPLY CONTAINERS

(75) Inventors: Susan Hmelar, Berlin (DE); David O. Merrill; Glen E. Schmidt, both of Corvallis, OR (US); John A. Underwood, Vancouver, WA (US); Mark J. Green, Sebastopol, CA (US); Thomas Cocklin, Ridgefield, WA (US); Bruce Cowger; Norman E. Pawlowski, Jr., both of Corvallis, OR (US); John A. Barinaga, Portland, OR (US); Charles R. Steinmetz, Corvallis, OR (US); Curt G. Gonzales, Corvallis, OR (US); John F. Wilson, Corvallis, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/177,144

(22) Filed: Oct. 20, 1998

Related U.S. Application Data

(63) Continuation-in-part of application No. 08/429,915, filed on Apr. 27, 1995, now abandoned, and a continuation-in-part of application No. 08/566,521, filed on Dec. 4, 1995, now abandoned, and a continuation-in-part of application No. 08/671,134, filed on Jun. 27, 1996, now abandoned.

(51) Int. Cl.[7] ..... B41J 2/175
(52) U.S. Cl. ..... 347/86
(58) Field of Search ..... 347/49, 85, 86, 347/87

(56) References Cited

U.S. PATENT DOCUMENTS

| | | | |
|---|---|---|---|
| 4,053,901 | 10/1977 | Skafvenstedt et al. . | |
| 4,156,244 | 5/1979 | Erikson et al. . | |
| 4,183,031 | 1/1980 | Kyser et al. . | |
| 4,187,511 | 2/1980 | Robinson . | |
| 4,383,263 | 5/1983 | Ozawa et al. . | |
| 4,412,232 | 10/1983 | Weber et al. . | |
| 4,447,820 | 5/1984 | Terasawa . | |
| 4,511,906 | 4/1985 | Hara . | |
| 4,542,390 | 9/1985 | Bruning et al. . | |
| 4,558,326 | 12/1985 | Kimura et al. . | |
| 4,568,954 | 2/1986 | Rosback . | |
| 4,590,494 | 5/1986 | Ichihashi et al. . | |
| 4,658,273 | 4/1987 | Yuki et al. . | |
| 4,699,356 | 10/1987 | Hargrove et al. | 251/149.6 |
| 4,700,205 | 10/1987 | Rich et al. . | |
| 4,714,937 | 12/1987 | Kaplinsky . | |
| 4,737,801 | 4/1988 | Ichihashi et al. . | |
| 4,831,389 | 5/1989 | Chan . | |
| 4,853,708 | 8/1989 | Walters . | |
| 4,907,019 * | 3/1990 | Stephens | 347/86 |
| 4,970,533 | 11/1990 | Saito et al. . | |
| 4,973,993 | 11/1990 | Allen . | |
| 4,987,429 | 1/1991 | Finley et al. . | |
| 4,992,802 | 2/1991 | Dion et al. . | |
| 4,999,652 | 3/1991 | Chan . | |

(List continued on next page.)

FOREIGN PATENT DOCUMENTS

| | | | |
|---|---|---|---|
| 0424133B1 | 4/1991 | (EP) | B41J/2/175 |
| 0567270B1 | 10/1993 | (EP) | B41J/2/175 |

* cited by examiner

*Primary Examiner*—Huan Tran
*Assistant Examiner*—Michael Nghiem
(74) *Attorney, Agent, or Firm*—Kevin B. Sullivan

(57) ABSTRACT

The present disclosure relates to an ink supply container for containing ink. The ink supply container is configured for providing ink to an ink jet printing system. The ink container includes a first feature indicative of an ink family of a plurality of ink families associated with ink contained in the container. Also included is a second feature spaced from the first feature. The second feature is indicative of an ink color of a plurality of ink colors associated with ink in the container.

26 Claims, 10 Drawing Sheets

U.S. PATENT DOCUMENTS

| | | | |
|---|---|---|---|
| 5,070,347 | 12/1991 | Yuki et al. . | |
| 5,119,115 | 6/1992 | Buat et al. . | |
| 5,182,581 | 1/1993 | Kashimura et al. . | |
| 5,216,452 | 6/1993 | Suzuki . | |
| 5,293,913 | 3/1994 | Preszler | 141/367 |
| 5,359,357 | 10/1994 | Takagi et al. | 347/49 |
| 5,396,316 | 3/1995 | Smith | 355/256 |
| 5,400,573 | 3/1995 | Crystal et al. | 53/468 |
| 5,406,320 | 4/1995 | Durst et al. | 347/86 |
| 5,408,746 | 4/1995 | Thoman et al. | 29/890.1 |
| 5,448,818 | 9/1995 | Scheffelin et al. | 29/509 |
| 5,519,422 * | 5/1996 | Thoman et al. | 347/49 |
| 5,530,531 * | 6/1996 | Girard | 355/260 |
| 5,561,450 * | 10/1996 | Brewster et al. | 347/49 |
| 5,777,646 | 7/1998 | Barinaga et al. | 347/86 |
| 5,825,387 | 10/1998 | Cowger et al. | 347/86 |

METHOD AND APPARATUS FOR KEYING INK SUPPLY CONTAINERS

CROSS REFERENCE TO RELATED APPLICATIONS

This application is a a continuation-in-part of patent application Ser. No. 08/429,915, now U.S. Pat. No. 5,825,387 filed Apr. 27, 1995 entitled "Ink Supply for an Ink-Jet Printer", Attorney Docket Number 1094053-2 and is a continuation-in-part of patent application Ser. No. 08/566,521, filed Dec. 4, 1995 now abandoned entitled "Keying System For Ink Supply Containers" Attorney Docket Number 10950919-1 and is a continuation-in-part of patent application Ser. No. 08/671,134 filed Jun. 27, 1996 now abandoned entitled "Integrated Latching, Keying and Aligning Features for Ink Containers" Attorney Docket Number 10960399-1, now U.S. Pat. No. 5,588,142 issued Dec. 24, 1996. These applications are assigned to the assignee of the present invention and incorporated herein by reference.

BACKGROUND OF THE INVENTION

The present invention relates to a system for ensuring that a replaceable ink supply container is properly oriented when inserted into an ink-jet printer.

A typical ink-jet printer has a pen mounted to a carriage which is moved back and forth over a printing surface, such as a piece of paper. The pen carries a print head. As the print head passes over appropriate locations on the printing surface, a control system activates ink jets on the print head to eject, or jet, ink drops onto the printing surface and form desired images and characters.

Some ink-jet printers use stationary ink supplies that are mounted away from the carriage and that supply ink to a refillable ink reservoir built into the pen. The ink may be supplied from the supply container to the pen through a tube that extends between the pen and the container.

Color ink-jet printers typically combine four ink colors to create a multitude of colors on the printing surface. Such printers can include a replaceable supply container for each color (typically black, cyan, yellow and magenta) used by the printer. A group of pens, each dedicated to a particular color, are mounted to the printer carriage. A separate ink delivery system for each color of ink is required.

Specifically, the entire path for one color of ink from its supply container to the pen and out the print head is dedicated for use by a single color of ink. Accordingly, a four-color ink-jet printer is configured to incorporate four discrete ink delivery systems, one for each color.

Some ink-jet printing systems provide for different classes or families of ink for use with different models of printers. For example, a printer designed to provide a very high quality print output may use ink having chemical and physical properties that are unlike the inks used with less-costly printer designs or families.

Contaminating one color ink with another, such as by introducing an ink of one color into the ink delivery system of another color, can ruin the color print quality. Moreover, directing the ink of one family into the delivery system of another family, can be disastrous for a printer. For example, if two black inks from different families were mixed together as a result of replacing one supply with the other, the mixture could react to form a precipitate and clog the ink delivery system, resulting in failure of the printer.

It is generally not a problem keeping inks of different colors and different ink families separated in printers that make use of replaceable cartridges having an integrated printhead and ink storage container. Because the entire ink supply, printhead and ink conduit between the ink supply and printhead are replaced with the ink cartridge there is generally not a concern of ink of different colors or families mixing. In contrast, there is great opportunity for inks of different ink families or different ink colors to become intermixed in printers which make use of ink storage units that are replaceable separately from the printhead. Replacing the ink storage unit with an ink color or ink family that is different from the previous ink storage unit results in the mixing of ink from the replacement ink storage unit with ink remaining in the printhead and ink conduit from the previous ink storage unit. This intermixing of ink colors tends to produce unpredictable colors reducing the quality of output images. In addition, the mixing of ink families can result in chemical interactions between the residual ink and replacement ink which can result in a precipitate which can block the ink passages or result in unpredictable performance of the printhead.

There is an ever present need for systems for insuring that ink containers having the proper ink parameters are correctly inserted into the ink jet printer. These systems should insure that the ink container is properly aligned so that proper fluid interconnect is provided between the ink container and the printhead. In addition, this system should provide some form of tactile feedback so that the user knows that the ink container is properly inserted into the printer. And finally, this system should provide some means for securing the ink container in the ink jet printer so that the ink container does not inadvertently become disconnected thereby causing ink spillage. This system should be cost effective and easily manufactured.

SUMMARY OF THE INVENTION

The present invention is an ink container for supplying ink having proper ink parameters to an ink container receiving station. The ink container includes a first feature indicative of ink family associated with the ink container and a second feature indicative of ink color associated with the ink container.

Another aspect of the present invention is where the ink container includes a shell and a cap, the cap is attachable to the shell and wherein each of the first and second features are attached to the cap.

In one preferred embodiment the first and second features are latch features. The latch features are configured for engaging ink container receiving station latch surfaces, for securely mounting ink containers having proper ink parameters to the ink container receiving station. In this preferred embodiment the first latch feature is a first plurality of tabs and the second latch feature is a second plurality of tabs, spaced from the first plurality of tabs.

Another aspect of the present invention is an ink container receiving station for receiving ink containers having proper ink parameters. The ink container receiving station includes a latching mechanism configured for engaging corresponding ink container latching features and securing ink containers to the supply station. The ink container receiving station includes a keying system component to define, in conjunction with ink container latch features, ink containers having proper ink parameters.

DETAILED DESCRIPTION OF THE PREFERRED EMBODIMENT

Figure 1:
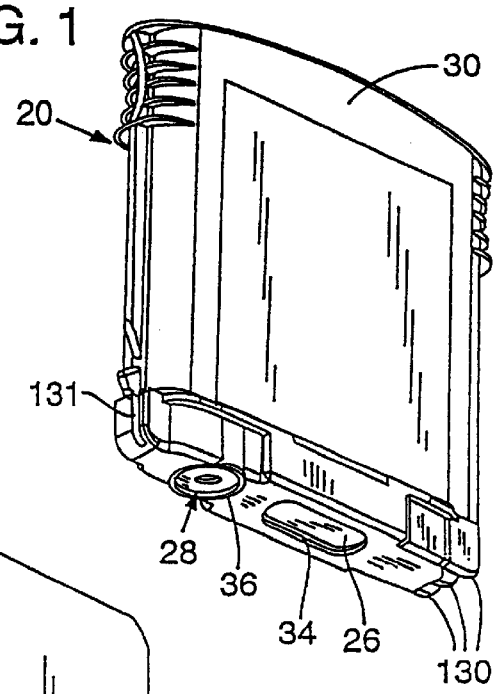
FIG. 1 is a perspective view of an ink supply container that carries a component of a preferred embodiment of the keying system of the present invention.
Figure 2:
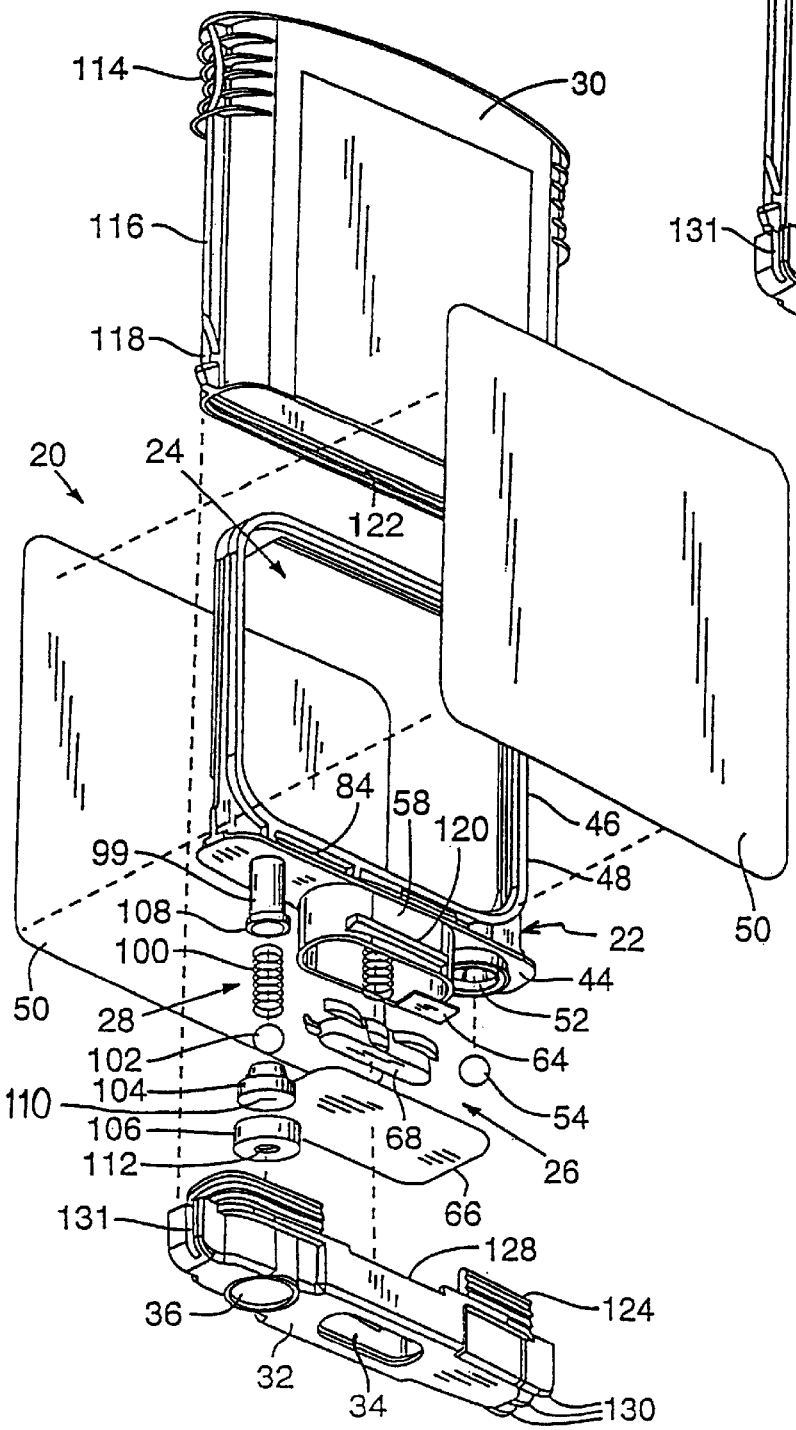
FIG. 2 is an exploded perspective view of the ink supply container of FIG. 1.

One embodiment of an ink supply container that carries a component of the keying system of the present invention is illustrated in FIGS. 1 and 2 as reference numeral 20. The ink supply container 20 (occasionally referred to merely as ink "supply") has a chassis 22 that carries an ink reservoir 24 for containing ink. The chassis also carries a pump 26, and a fluid outlet 28. The chassis 22 fits within the lower open end of a hard protective shell 30. A cap 32 is affixed to the lower end of the shell. The cap 32 is provided with an aperture 34 to allow access to the pump 26 and an aperture 36 to allow access to the fluid outlet 28.

Figure 6:
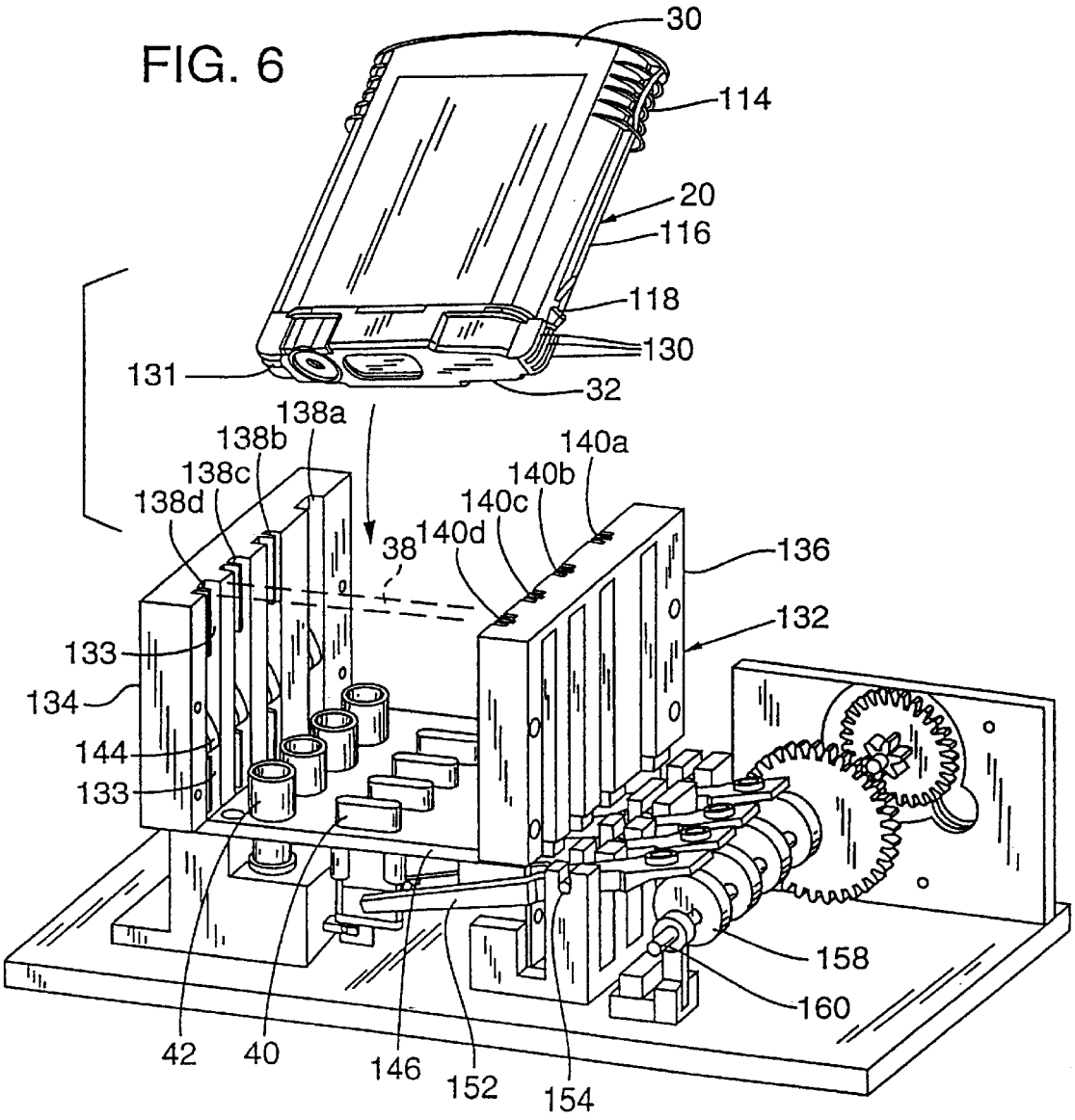
FIG. 6 shows the ink supply of FIG. 1 being inserted into a docking bay of a docking station.
Figure 7:
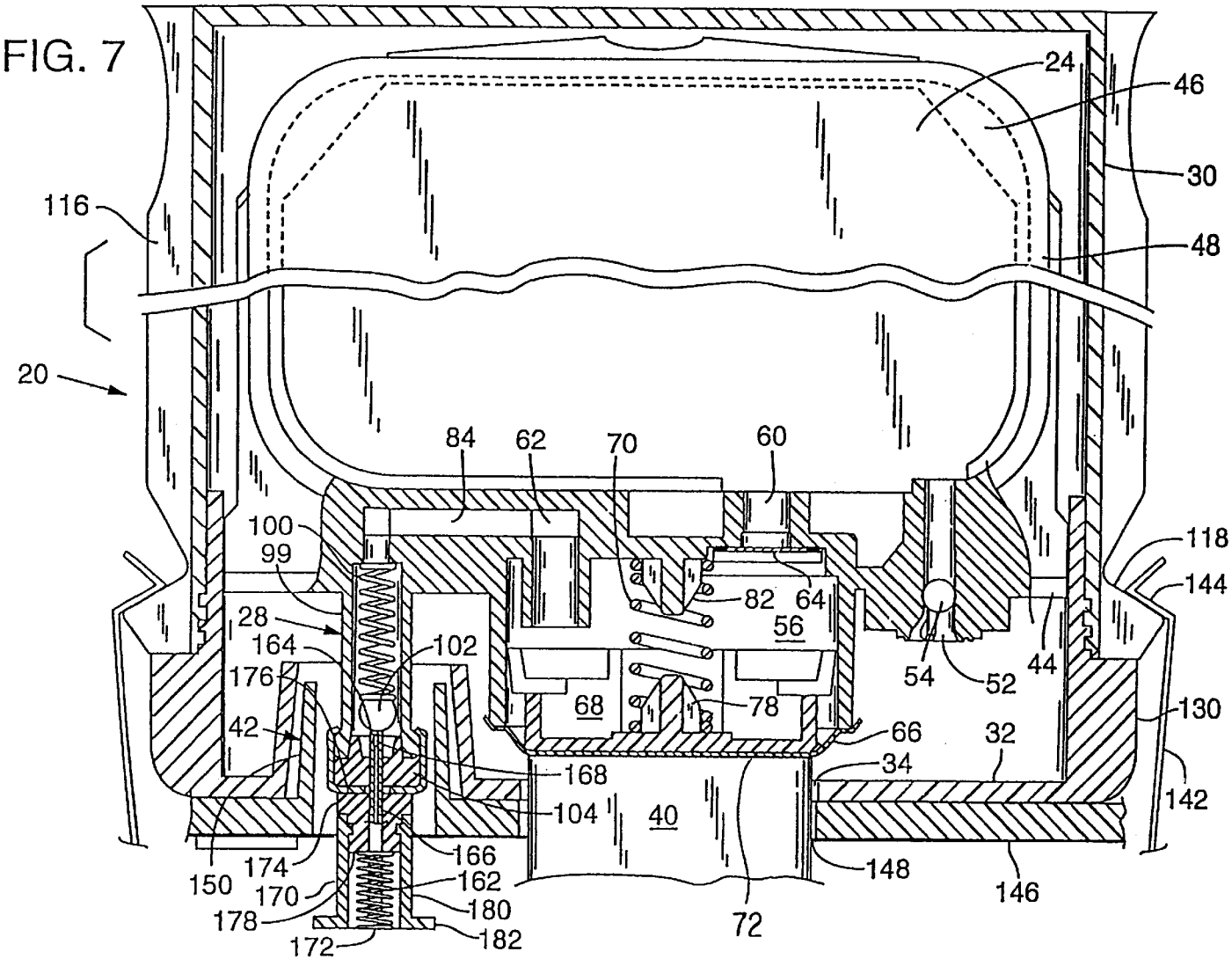
FIG. 7 is a cross sectional view showing the ink supply of FIG. 1 fully inserted into the docking bay.

The ink supply 20 is inserted into the appropriate bay 38 of a docking station 132 of an ink-jet printer, as illustrated in FIGS. 6–7 (and described more fully below). Upon insertion of the ink supply 20, an actuator 40 within the docking bay 38 is brought into contact with the pump 26 through aperture 34. In addition, a fluid inlet 42 within the docking bay 38 is coupled to the container fluid outlet 28 through aperture 36, thereby to create an ink delivery path from the ink supply 20 to the corresponding pen on the printer carriage. Operation of the actuator 40 causes the pump 26 to draw ink from the reservoir and deliver the ink through the fluid outlet 28 and the fluid inlet 42 to the ink-jet pen through a tube, as discussed below.

Upon depletion of the ink from the reservoir 24, or for any other reason, the ink supply 20 can be easily removed from the docking bay 38. Upon removal, the fluid outlet 28 on the container and the fluid inlet 42 of the docking station close to prevent any residual ink from leaking into the printer or onto the user. The ink supply container may then be discarded or stored for reinstallation at a later time. In this manner, the ink supply 20 provides a user of an ink jet printer a simple, economical way to provide a reliable, and easily replaceable supply of ink to an ink-jet printer.

As illustrated in FIGS. 2 and 7, the chassis 22 has a main body 44. Extending upward from the top of the chassis body 44 is a frame 46 which helps define and support the ink reservoir 24. In the illustrated embodiment, the frame 46 defines a generally square reservoir 24. Each side of the frame 46 is provided with a face 48 to which a sheet of plastic 50 is attached to enclose the sides of the reservoir 24. The illustrated plastic sheet is flexible to allow the volume of the reservoir to diminish as ink is depleted from the reservoir. This helps to allow withdrawal and use of all of the ink within the reservoir by minimizing the amount of backpressure created as ink is depleted from the reservoir. The illustrated ink supply 20, is intended to contain about 30 cubic centimeters of ink when full.

In the illustrated embodiment, the plastic sheets 50 are heat staked to the faces 48 of the frame in a manner well known to those in the art. The plastic sheets 50 are, in the illustrated embodiment, multi-ply sheets having a an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor loss and leakage. Of course, in other embodiments, different materials, alternative methods of attaching the plastic sheets to the frame, or other types of reservoirs might be used.

The body 44 of the chassis 22, as seen in FIGS. 2 and 7, is provided with a fill port 52 for filling the reservoir 24. After filling the reservoir, a spherical plug 54 is inserted into the fill port 52 to prevent the escape of ink through the fill port. In the illustrated embodiment, the plug is a polypropylene ball that is press fit into the fill port.

The pump 26 on the chassis 22 serves to pump ink from the reservoir and supply it to the printer via the fluid outlet 28. In the illustrated embodiment, the pump 26 includes a pump chamber 56 that is integrally formed with the chassis 22. The pump chamber is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink may be drawn from the ink reservoir, through the pump inlet and into the chamber. When the chamber is pressurized, ink within the chamber may be expelled through the pump outlet.

In the illustrated embodiment, the valve 64 is a one-way flapper valve positioned at the bottom of the pump inlet. The valve 64 is a rectangular piece of flexible material positioned over the bottom of the pump inlet 60 and heat staked to the chassis 22 at the midpoints of its short sides (the heat staked areas are darkened in FIG. 7). When the pressure within the chamber drops sufficiently below that in the reservoir, the unstaked sides of the valve each flex downward to allow the flow of ink around the valve 64, through the pump inlet 60 and into the chamber 56.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm allows the diaphragm to flex up and down to vary the volume within the chamber. In the illustrated ink supply, displacement of the diaphragm allows the volume of the chamber 56 to be varied by about 0.7 cubic centimeters. The fully expanded volume of the illustrated chamber 56 is between about 2.2 and 2.5 cubic centimeters.

A pressure plate 68 and a spring 70 are positioned within the chamber 56. The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate downward against the diaphragm to increase the volume of the chamber.

A conduit 84 joins the pump outlet 62 to the fluid outlet 28. In the illustrated embodiment, the top wall of the conduit 84 is formed by the lower member of the frame 46, the bottom wall is formed by the body 44 of the chassis, one side is enclosed by a portion of the chassis and the other side is enclosed by a portion of one of the plastic sheets.

As illustrated in FIGS. 2 and 7, the fluid outlet 28 is housed within a hollow cylindrical boss 99 that extends downward from the chassis 22. The top of the boss 99 opens into the conduit 84 to allow ink to flow from the conduit into the fluid outlet. A spring 100 and sealing ball 102 are positioned within the boss 99 and are held in place by a compliant septum 104 and a crimp cover 106. The septum 104 is inserted into the boss 99 and compresses the spring 100 slightly so that the spring biases the sealing ball 102 against the septum 104 to form a seal. The crimp cover 106 fits over the septum 104 and engages an annular projection 108 on the boss 99 to hold the entire assembly in place.

In the illustrated embodiment, both the spring 100 and the ball 102 are stainless steel. The sealing ball 102 is sized such that it can move freely within the boss 99 and allow the flow of ink around the ball when it is not in the sealing position. The septum 104 is formed of polyisoprene rubber and has a concave bottom to receive a portion of the ball 102 to form a secure seal. The septum 104 is provided with a slit 110 so that it may be easily pierced without tearing or coring. The slit is normally closed. A hole 112 is provided so that the crimp cover 106 does not interfere with the piercing of the septum 104.

With the pump 26 and fluid outlet 28 in place, the ink reservoir 24 can be filled with ink. To fill the ink supply 24, ink can be injected through the fill port 52. As ink is being introduced into the reservoir, a needle (not shown) can be inserted through the slit 110 in the septum 104 to depress the sealing ball 102 and allow the escape of any air from within the reservoir.

Of course, there are a variety of other methods which might also be used to fill the present ink supply. In some instances, it may be desirable to flush the entire ink supply with carbon dioxide prior to filling it with ink. In this way, any gas trapped within the ink supply during the filling process will be carbon dioxide, not air. This may be preferable because carbon dioxide may dissolve in some inks while air may not. In general, it is preferable to remove as much gas from the ink supply as possible so that bubbles and the like do not enter the print head or the trailing tube. To this end, it may also be preferable to use degassed ink to further avoid the creation or presence of bubbles in the ink supply.

Although the ink reservoir 24 provides an ideal way to contain ink, it may be easily punctured or ruptured and may allow a small amount of water loss from the ink. Accordingly, to protect the reservoir 24 and to limit water loss, the reservoir 24 is enclosed within the protective shell 30. In the illustrated embodiment, the shell 30 is made of polypropylene. A thickness of about one millimeter has been found to provide robust protection and to prevent unacceptable water loss from the ink. However, the material and thickness of the shell may vary in other embodiments.

The top of the shell 30 has contoured gripping surfaces 114 (FIG. 6) that are shaped and textured to allow a user to easily grip and manipulate the ink supply 20. A vertical rib 116 having a detent 118 formed near its lower end projects laterally from each side of the shell 30. The base of the shell 30 is open to allow insertion of the chassis 22. A stop 120 extends laterally outward from each side of wall 58 that defines the chamber 56 (FIG. 2). These stops 120 abut the lower edge of the shell 30 when the chassis 22 is inserted.

After the reservoir is filled, the protective cap 32 is fitted to the bottom of the shell 30 to maintain the chassis 22 in position. The cap 32 is provided with slots 128 which receive the stops 120 on the chassis 22. In this manner, the stops are firmly secured between the cap and the shell to maintain the chassis in position. The cap aperture 34 allows access to the pump 26, and aperture 36 allows access to the fluid outlet 28. The cap 32 obscures the fill port 52.

In the illustrated embodiment, the bottom of the shell 30 is provided with two circumferential grooves 122 which engage two circumferential ribs 124 formed on the cap 32 to secure the cap to the shell. Sonic welding or some other mechanism may also be desirable to more securely fix the cap to the shell. In addition, a label can be adhered to both the cap and the shell to more firmly secure them together. A pressure sensitive adhesive is used to adhere the label in a manner that prevents the label from being peeled off and to help secure the cap to the shell.

The attachment between the shell and the cap should, preferably, be snug enough to prevent accidental separation of the cap from the shell and to resist the flow of ink from the shell should the ink reservoir develop a leak. However, it is also desirable that the attachment allow the slow ingress of air into the shell as ink is depleted from the reservoir to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 12 and the flexible reservoir 14 which it contains have the capacity to hold approximately thirty cubic centimeters of ink. The shell is approximately 73 millimeters wide, 15 millimeters thick, and 60 millimeters high. Of course, other dimensions and shapes can also be used depending on the particular needs of a given printer.

The shell 30 is substantially symmetrical about is vertical central axis. Accordingly, the shell may be joined with the cap in either of two orientations of the shell, thereby simplifying the container assembly process.

In accordance with the present invention, it is contemplated that the components of the ink supply container, except for the protective cap 32, may be used to contain any of a number of different types of ink. One can divide types of ink, for example, into two subcategories: family and color. A family of ink refers to the particular chemical and physical properties of the ink, such as its viscosity or solubility in water. Ink-jet pens and print heads that are designed to work with ink of a particular family will malfunction if ink of a different family is used. The ink color relates to one of four colors that are typically used in color printing and combined on the printing medium to yield the sought-after color output. In this regard, the ink delivery system for providing ink to the print head is limited to use with only one color and, therefore, must not be contaminated with ink of another color.

The protective cap 32 of the present invention includes features formed thereon to provide indicia of the particular single family and color of the ink contained in the reservoir. Similar features are provided in the docking station bays. These features on the ink container and in the docking station bays are the primary components of a system that prevents insertion of any ink containers into a particular bay, except for the single ink supply container that has a cap bearing the appropriate features for mating with corresponding features of the particular bay.

In accordance with the present invention, one end of the cap 32 is provided with features comprising projecting keys 130 that can identify the family of ink contained within the ink supply. For example, if the ink supply is filled with ink suited for use only with a particular printer or family of printers, a cap having keys of a selected number and spacing (in the illustrated embodiment, three evenly spaced keys 130 are shown) for indicating that ink family is contained in the supply. The other end of the cap is provided with a feature, a keyway 131, that is indicative of a certain color of ink, such as cyan, magenta, etc. As will be explained below, the docking station in the printer carries features that mate with those on a cap to control the insertion of the containers into the station.

It is notable here that the chassis 22 and shell 30 can be manufactured, assembled and stored without regard to the particular type of ink they will contain. Then, after the ink reservoir is filled, a cap bearing features indicative of the particular ink type within the reservoir is attached to the shell. This allows for manufacturing economies because a supply of empty shells and chassis can be stored in inventory. When there is a demand for a particular type of ink, that ink can be introduced into the ink supply and an appropriate cap fixed to the ink supply. Thus, this scheme reduces the need to maintain high inventories of ink supplies containing every type of ink.

Alternative or supplementary ink content indicia may be incorporated into the cap. For example, when the ink supply is filled with a particular color of ink, a cap that is colored to match that color may be used. The color of the cap may also be used to indicate the family of ink contained within the ink supply.

Figure 4:
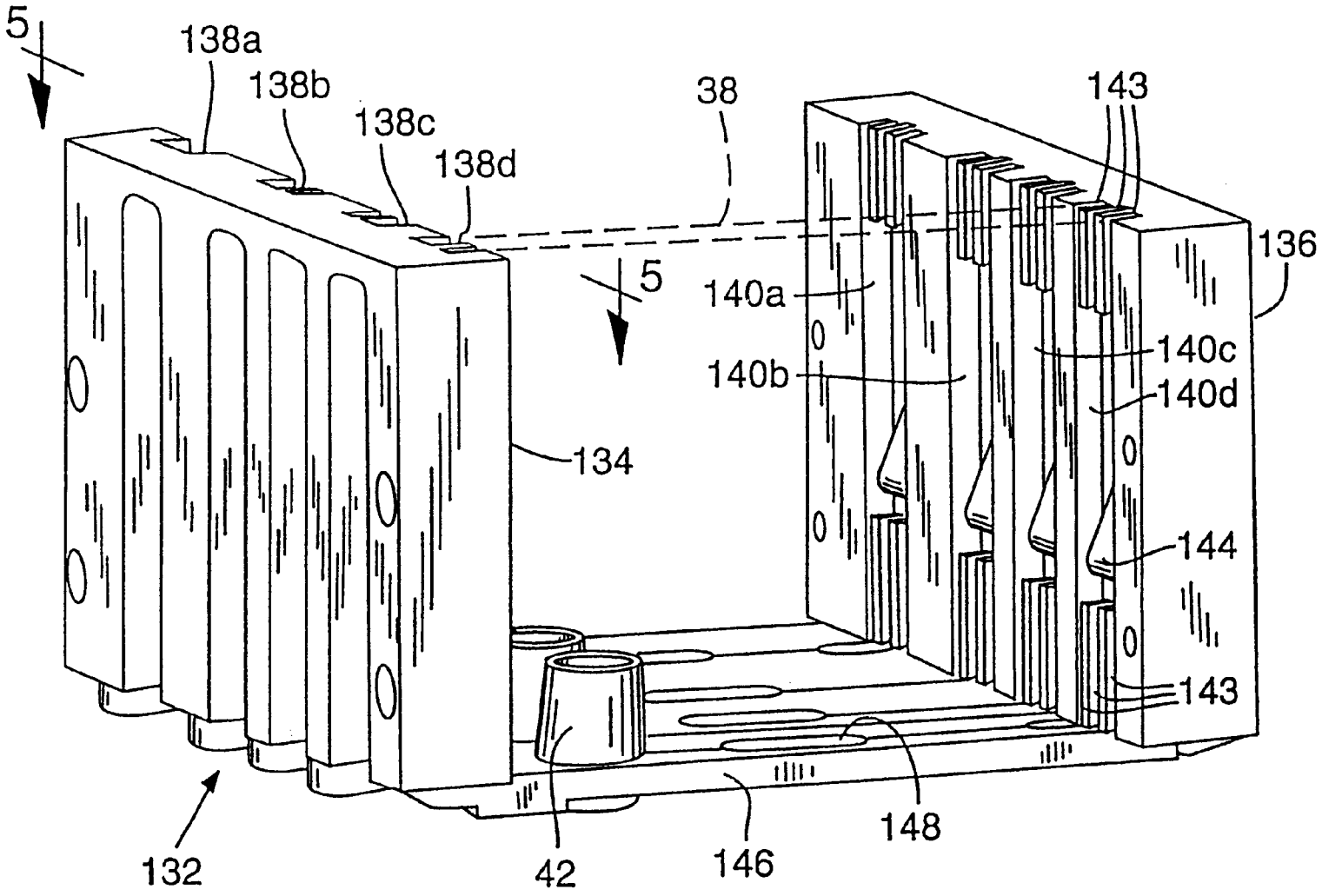
FIG. 4 is a perspective view of part of a printer docking station that includes another component of a preferred embodiment of the keying system of the present invention.

The illustrated ink supply 20 is ideally suited for insertion into a docking station 132 like that illustrated in FIGS. 4–7. The docking station 132 illustrated in FIG. 4, is intended for use with a color printer. Accordingly, it has four side-by-side docking bays 38, each of which can receive one ink supply container 20 of a different color. The structure of the illustrated ink supply allows for the supply to be relatively narrow in width. This allows for four ink supplies to be arranged side-by-side in a compact docking station without unduly increasing the "footprint" of the printer.

The docking bays 38 reside between opposing walls 134, 136 of the station. Each wall respectively defines four inwardly facing vertical channels 138*a–d,* 140*a–d*. Each bay 38 (the upper boundary of one bay is shown in dashed lines in FIGS. 4–6) receives one ink supply 20.

A leaf spring 142 having an engagement prong 144 is positioned within the lower portion of each channel 138*a–d,* 140*a–d*. The engagement prong 144 of each leaf spring 142 extends inwardly into the docking bay 38 and is biased inward by the leaf spring.

Figure 5:
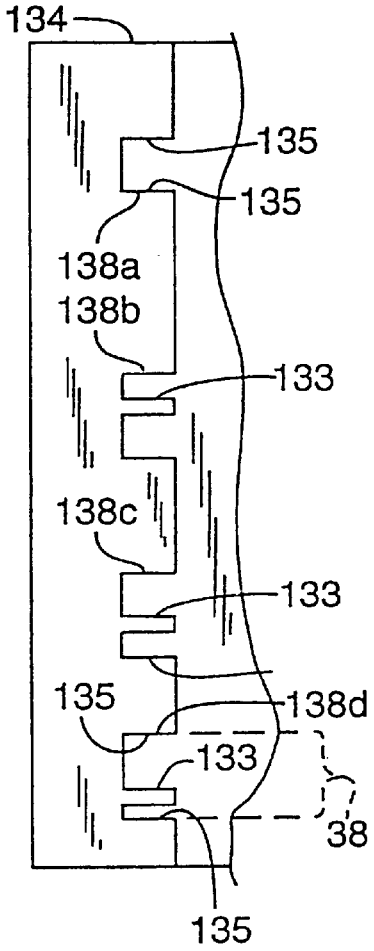
FIG. 5 is a top partial view of one wall of the docking station detailing part of the keying system of the present invention.

Each of the channels 138*a–d* formed in one wall 134 of the station (for convenience referred to as the left wall) is shaped to define features that mate with a keyway 131 formed in the protective cap 32. FIG. 5 best illustrates the configuration of the features in the left wall 134, where the individual channels 138*a–d* each have discrete keying characteristics.

Turning to an exemplary channel 138*d* in the left wall 134, it is seen that channel 138*d* has a protruding key 133 defined between its sidewalls 135. With reference to FIG. 6, the protruding key 133 is a generally elongated member extending in the vertical direction between the parallel side walls 135 of the channel 138*d*. In a preferred embodiment, the key 133 is in two parts: an upper part that is located at the upper end of the wall 134, and a lower part that extends from the bottom of the wall 134 to a location just beneath the prong 144 that resides in the channel 138*d*.

The thickness (measured vertically in FIG. 5) of the key 133, and the spacing of that key between the sidewalls 135 of the channel 138*d*, is established to mate with a keyway 131 formed in the end of a particular protective cap 32. In this regard, attention is directed to FIG. 3D, which is a bottom view of the cap 32 depicted in FIG. 1. That cap is configured on one end (the left end in FIG. 3D) so that the width of that end part between the sidewalls 139 is just slightly less than the space between the sidewalls 135 of the channel 138*d*. Moreover, the width of the keyway 131 is just slightly wider than the thickness of the key 133 in that channel 138*d*. Put another way, the configuration of the cap end illustrated in FIG. 3D is essentially the mirror image of the configuration of channel 138*d* (FIG. 3D is a bottom view and FIG. 5 is a top view). Accordingly, the left end of the version of the cap 32 shown in FIG. 3D will mate with, and only with, the channel 138*d* in the leftwall 134.

The right end of the cap, as mentioned earlier, includes three evenly spaced projecting keys 130 that may be indicative of a particular family of ink used with the illustrated docking bay. The channels 140*a–d* in the wall 136 of the docking station are constructed at their tops and bottoms (see FIG. 4) to define three evenly spaced apart keyways 143 that mate with the family keys 130 on the cap. Specifically, the keyways 143 are defined as the spaces between upper and lower protrusions extending between the sidewalls of the channels 140*a–d*. Like the keys 133 in the opposing wall 134, these protrusions are in two parts, at the top and bottom of the channels, as shown in FIG. 4.

Turning to FIGS. 3A–C and FIG. 5, it will be appreciated that, with the foregoing in mind, the configurations of the other channels 138*a–c* in the left wall 124 of the docking station define features that will mate only the container caps that have correspondingly shaped features on the associated end of the caps. For example, the end of the cap depicted in FIG. 3A (for reference called the "black ink" cap) is constructed so that the gap between the sidewalls 139 of that end is relatively narrower than that dimension of other caps. The end of the black ink cap (FIG. 3A) fits snugly within a correspondingly narrow channel 138*a* in the left wall 134 of the docking station. The black ink cap does not include a keyway in the end of that cap 32, and the channel 138*a* does not include a distinct key.

Figure 3A:
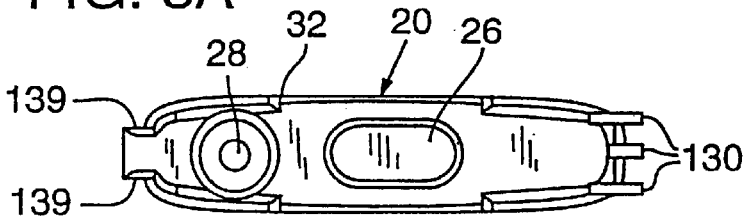
FIGS. 3A–3D are bottom views of the supply container caps showing various key and keyway components of a preferred embodiment of the keying system of the present invention.
Figure 3B:
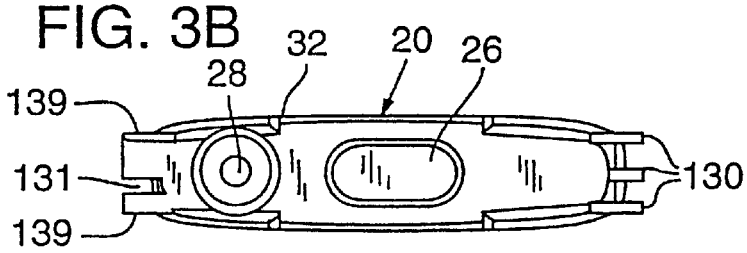
Figure 3C:
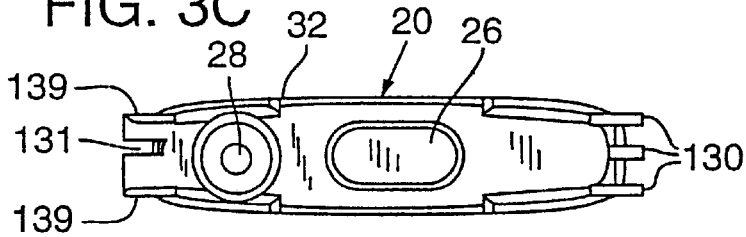
Figure 3D:
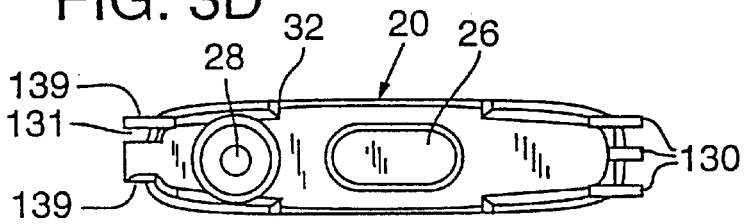

The ends of the caps depicted in FIGS. 3B and 3C illustrate alternative arrangements of cap configurations that include keyways 131 located and sized for mating with only one of the channels 138*b* or 138*c*, respectively.

It is contemplated that more than just four different caps, associated with four different colors, can be employed with the keying system of the present invention. In this regard, the width of the associated end of the cap and the location of keyways on the cap (and keys in the docking bay channels) may be designed in any of a multitude of configurations, provided that the configuration for a particular cap is unique to a pen color, and that the keying system permits the fluid outlet 28 of the supply 20 and the pump 26 to respectively align with the fluid inlet 42 and actuator 40 of the docking bay.

In addition to controlling insertion of a particular ink container into its corresponding, mating, bay, it will be appreciated that the above-described key features also serve to guide movement of the container into and out of the bay. In this regard, the vertical length of the keys and keyways are selected so that as the container is moved into the bay the container is limited to sliding translational motion to facilitate precise interconnection between the fluid outlet 28 and fluid inlet 42.

As illustrated in FIGS. 6 and 7, the upper end of each actuator 40 extends upward through the aperture 148 in the base plate 146 of the station 132 and into the docking bay 38. The lower portion of the actuator 40 is positioned below the base plate and is pivotably coupled to one end of a lever 152 which is supported on a pivot point 154. The other end of the lever 152 is biased downward by a compression spring (not shown). In this manner, the force of the compression spring urges the actuator 40 upward. A cam 158 mounted on a rotatable shaft 160 is positioned such that rotation of the shaft to an engaged position causes the cam to overcome the force of the compression spring and move the actuator 40 downward. Movement of the actuator causes the pump 26 to draw ink from the reservoir 24 and supply it through the fluid outlet 28 and the fluid inlet 42 to the printer.

As seen in FIG. 7, the fluid inlet 42 is positioned within the housing 150 carried on the base plate 146. The illustrated fluid inlet 42 includes an upwardly extending needle 162 having a closed blunt upper end 164, a blind bore 166 and a lateral hole 168 near the blunt end. A trailing tube (not shown) is connected to the lower end of the needle 162 such that the blind bore 166 is in fluid communication therewith. The trailing tube (not shown) leads to a print head (not shown).

A sliding collar 170 surrounds the needle 162 and is biased upwardly by a spring 172. The sliding collar 170 has a compliant sealing portion 174 with an exposed upper surface 176 and a lower surface 178 in direct contact with the spring 172. In addition, the illustrated sliding collar includes a substantially rigid portion 180 extending downwardly to partially house the spring 172. An annular stop 182 extends outward from the lower edge of the substantially rigid portion 180. The annular stop 182 is positioned beneath the base plate 146 such that it abuts the base plate to limit upward travel of the sliding collar 170 and define an upper position of the sliding collar on the needle 162. In the upper position, the lateral hole 168 is surrounded by the sealing portion 174 of the collar to seal the lateral hole, and the blunt end 164 of the needle is generally even with the upper surface 176 of the collar.

To install an ink supply 20 within a docking bay 38, a user can simply place the lower end of the mating ink supply container between the opposing walls 134 and 136 that define a mating bay 38 (FIG. 6). The ink supply is then pushed downward into the installed position, shown in FIG. 7, in which the bottom of the cap 32 abuts the base plate 146. As the ink supply is pushed downward, the fluid outlet 28 and fluid inlet 42 automatically engage and open to form a path for fluid flow from the ink supply to the printer. Once the supply is installed, the actuator may enter the aperture 34 in the cap 32 to pressurize the pump.

Once in position, the engagement prongs 144 on each side of the docking station engage the detents 118 formed in the shell 30 to firmly hold the ink supply in place. The leaf springs 142, which allow the engagement prongs to move outward during insertion of the ink supply, bias the engagement prongs inward to positively hold the ink supply in the installed position. Throughout the installation process and in the installed position, the edges of the ink supply 20 are captured within the vertical channels 138 and 140 which provide lateral support and stability to the ink supply. The above-described keying components formed in bottom parts of the channels 138*a–d* and 140*a–d* are configured to provide clearance for the detents 118 and the central vertical ribs 116 formed in each side of the shell. In a preferred embodiment, the depth (measured left-to-right in FIG. 5) is sufficient to provide clearance for the detent 118 and rib 116, which may protrude outwardly slightly farther than the end of the cap 32. Similarly, the depth of the central one of the three keyways 143 in the right station wall 136 is sufficiently deep to provide clearance for the detent 118 and rib 116 on that side of the supply container.

To remove the ink supply 20, a user simply grasps the ink supply, using the contoured gripping surfaces 114, and pulls upward to overcome the force of the leaf springs 142. Upon removal, the fluid outlet 28 and fluid inlet 42 automatically disconnect and reseal leaving little, if any, residual ink and the pump 26 is depressurized to reduce the possibility of any leakage from the ink supply.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

Figure 8:
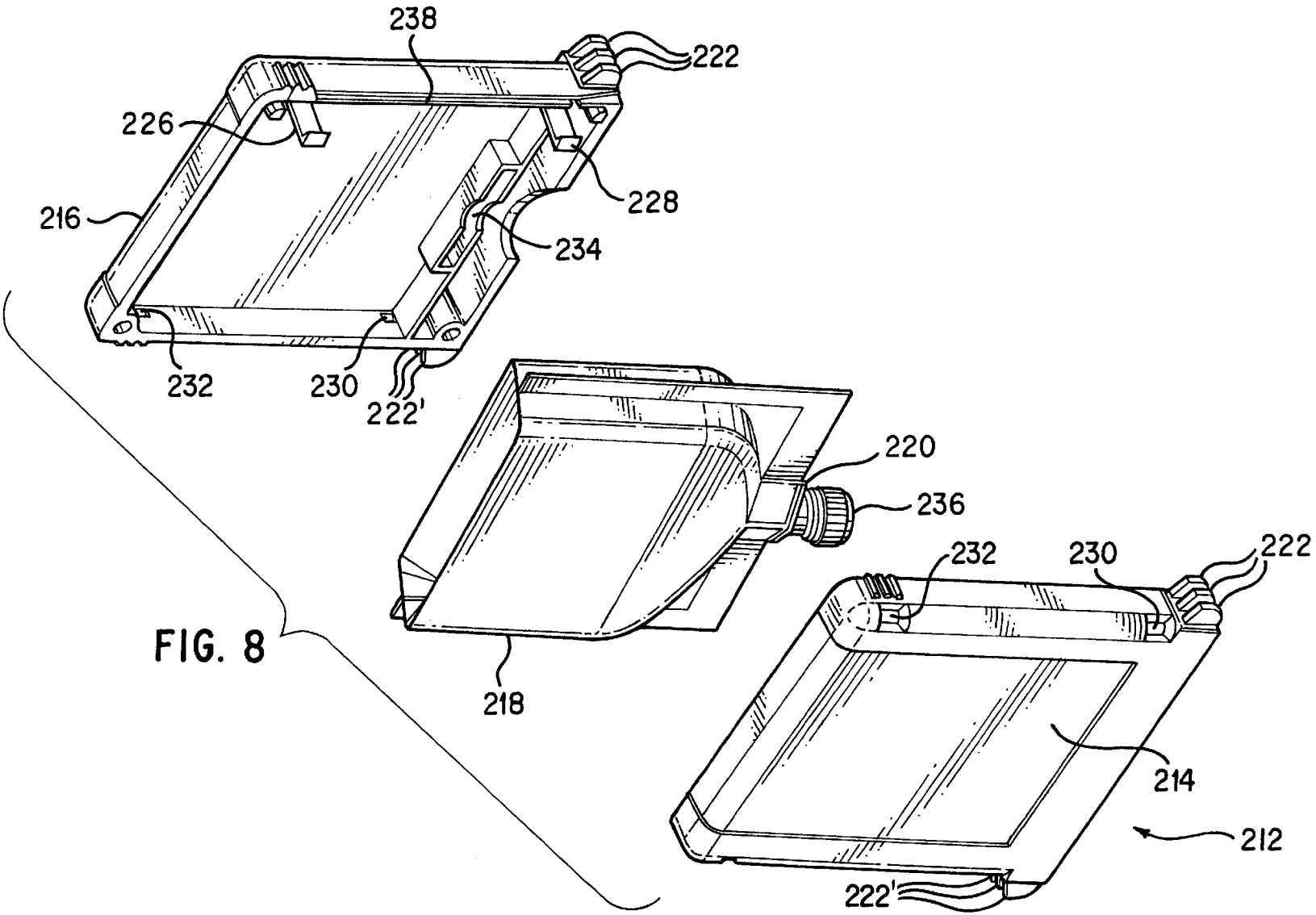
FIG. 8 is an exploded view of an alternative ink supply container which includes the latch features of the present invention which are indicative of ink parameters.

FIG. 8 shows an alternative embodiment of the ink container 212 of the present invention for use with an ink jet printer having an ink jet printhead (not shown). The ink container 212 is similar to the ink supply or container 20 except that the ink container 212 does not provide a pressurized supply of ink to the printing system. Instead, ink container 212 provides a source of non-pressurized ink the the printing system.

The ink container 212 of the present invention is configured for insertion into an ink container receiving station mounted on the printer for ensuring ink containers having compatible ink parameters are properly inserted into the printer and properly secured to the printer. The ink container receiving station will be discussed in more detail with respect to FIG. 9.

The ink container 212 includes housing members 214 and 216, an ink bag 218, and a fitment 220 for providing a fluid interconnect between the ink bag 218 and the printer (not shown). Also included in the ink container 212 are latch features 222 and 222' which are the subject of this invention.

Latch features 222 and 222' in conjunction with corresponding latch surfaces, as will be discussed with respect to FIG. 9, secure the ink container 212 to the printer. In addition, the latch features 222 and 222' provide keying features to prevent the insertion of ink containers having incompatible ink parameters. Finally, the latch features aid in the guiding and aligning of ink containers during the insertion of the ink containers into the ink container receiving station on the printer.

One aspect of latch features 222 and 222' of the present invention are to identify ink parameters of ink within the ink container 212. The latch features 222 and 222' are capable of identifying a large number of different ink parameters. These ink parameters include ink color and ink family, to name a few. The ink family is indicative of the chemical and physical properties of the ink formulation within the ink container 212. Ink formulations specify such ink parameters as solubility in water, waterfastness of the ink, ultraviolet stability of the ink etc. It is crucial that only ink containers having compatible ink parameters be installed in the printer. If incompatible ink containers are installed then the ink in the container will combine with residual ink in the printhead resulting in a degradation in the output image quality.

The latch features 222 and 222' in addition to identifying ink parameters also provide guiding and aligning features for inserting the ink container 212 into the ink container receiving station on the ink jet printer. The guiding and aligning features allow the user to insert the ink container 212 to make fluid connection with the printer without having to visually align the fluid interconnects. The user, therefore, need only insert the ink container 212, and if it is compatible, then the latch features 222 and 222' of the present invention will allow the ink container 212 to be inserted. During insertion, the latch features 222 and 222' align and guide the ink container 212 into the printer. An important aspect of the present invention is that the latch features 222 and 222' align the container 212 such that a fluid interconnection is made between the ink container 212 and the printer.

Another aspect of the present invention is that the latch features 222 and 222' are used to secure the ink container 212 to the printer. The latch features 222 and 222' together with latch surfaces located on the printer secure the ink container 212 to the printer. The latch surfaces will be discussed later with respect to FIG. 9.

In the preferred embodiment the ink container 212 is made from identical housing members 214 and 216. Use of identical housing members make it possible to form each of the housing members 214 and 216 using a single mold. The housing members are assembled as mirror images of each other. The use of a single mold for forming both of the housing members 214 and 216 reduces manufacturing costs as well as parts count. A reduction in parts count reduces costs associated with stocking and tracking of parts.

In this preferred embodiment housing member 216 includes fastening features 226 and 228 which interact with retaining features 230 and 232 on housing members 214 thereby forming a snap fastening of the housing members 214 and 216. Because housing members 214 and 216 are mirror images of each other, housing member 214 also includes fastening features 226 and 228 (not shown) similar to housing member 216. The fastening features of housing member 214 engage retaining features 230 and 232 on housing member 216 to fasten housing members 214 and 216 together. The use of fastening features 226 and 228 and retaining features 230 and 232 allow the fastening of housing members together without requiring additional parts thereby reducing manufacturing costs. In addition, the use of snap together housing members 214 and 216 allows the ink container 212 to be assembled relatively easily thereby reducing manufacturing cost.

Alternatively, the housing members 214 and 216 may be fastened using a wide variety of conventional fastening techniques such as bonding using an adhesive, one of a variety of welding techniques or fastening with a fastener such as a clip or screw.

In the preferred embodiment, the fitment 220 is attached to the ink bag in a conventional manner and the fitment 220 is secured in a fitment receiving portion 234 between the housing members 214 and 216. The fitment 220 includes a fluid interconnect portion 236 which includes a septum and a ball valve. The fluid interconnect portion 236 interacts with a corresponding fluid interconnect portion on the printer for providing a fluid interconnect between the ink container 212 and the printer. In the preferred embodiment the fluid interconnect portion of the printer includes a needle portion which pierces the septum and opens the ball valve as the ink container 212 is inserted into the printer using latch members 222 and 222'. Latch members 222 and 222'guide the ink container to align the fluid interconnect portions of each of the ink containers 212 and the printer. Alternatively, the fluid interconnect may be a conventional fluid interconnect which provides a reliable fluid interconnect.

In another embodiment, the ink container 212 contains a frame having a flexible sheet attached to the frame such as disclosed in Ser. No. 08/566,521. Alternatively, the ink container 212 may be formed without an ink bag 218 inside. For this alternative embodiment the housing members 214 and 216 can be either formed separately and hermetically sealed together to form the ink container 212 or the housing members 214 and 216 can be molded as a unitary member to form the ink container 212. In each of these embodiments, the housing members 214 and 216 form a hermetic seal or are a unitary member allowing ink to be placed directly in the housing members 214 and 216.

Figure 9:
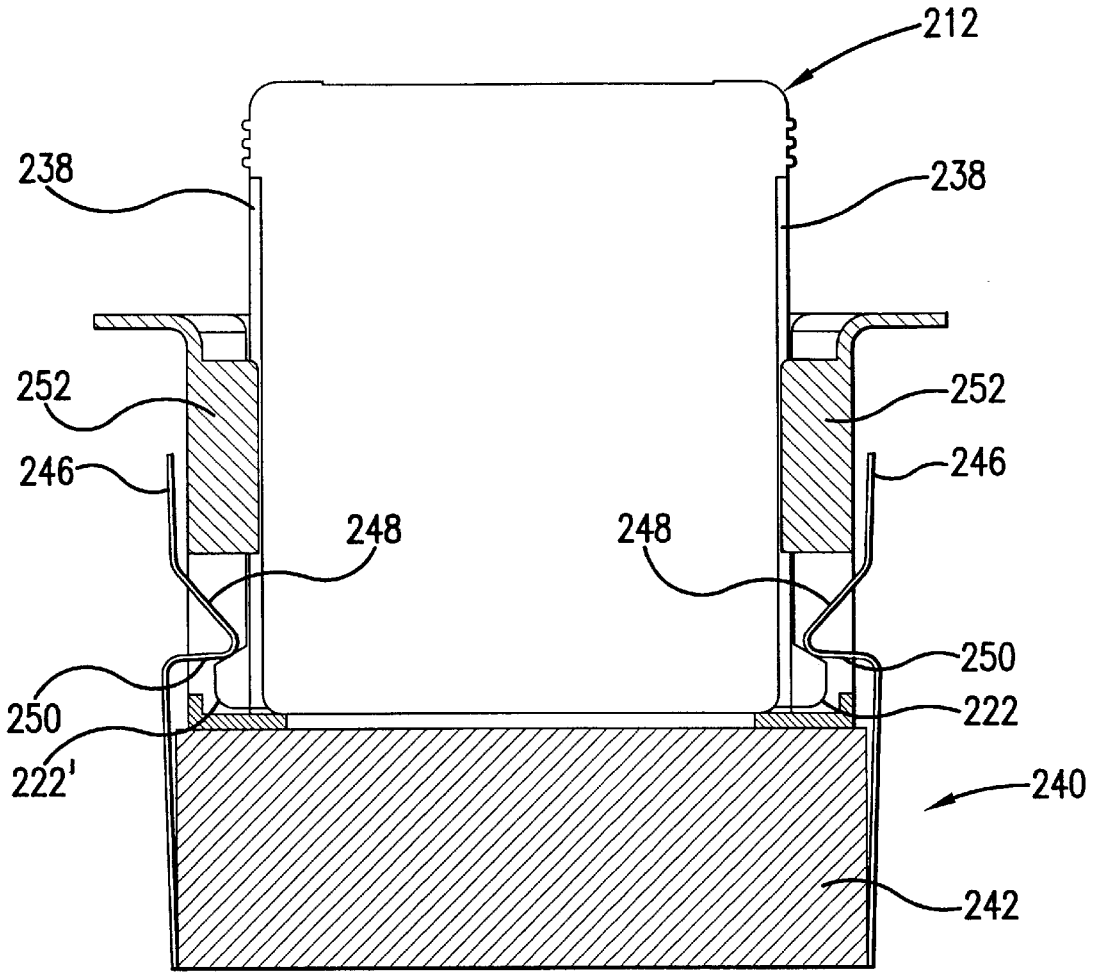
FIG. 9 is a perspective view of an ink container receiving station for receiving the ink container shown in FIG. 8.

FIG. 9 shows an ink container receiving station 240 for receiving the ink container 212 of the present invention. The ink container receiving station 240 is attached to the ink jet printer and is used in conjunction with the latch features 222 and 222' on the ink container 212 to insure ink containers 212 having the proper ink parameters are inserted into the printer. In addition, the ink container receiving station 240 together with the latch features 222 and 222' guide the ink container 212 during insertion into the printer to ensure the ink container fluid interconnect 236 properly aligns with the printer fluid interconnect. The ink container receiving station 240 includes a base 242 that is mounted to an ink jet printer 244. The receiving station 240 also includes latch members 246 for engaging the latch features 222 and 222' for securing the ink container 212 to the base 242.

Figure 10:
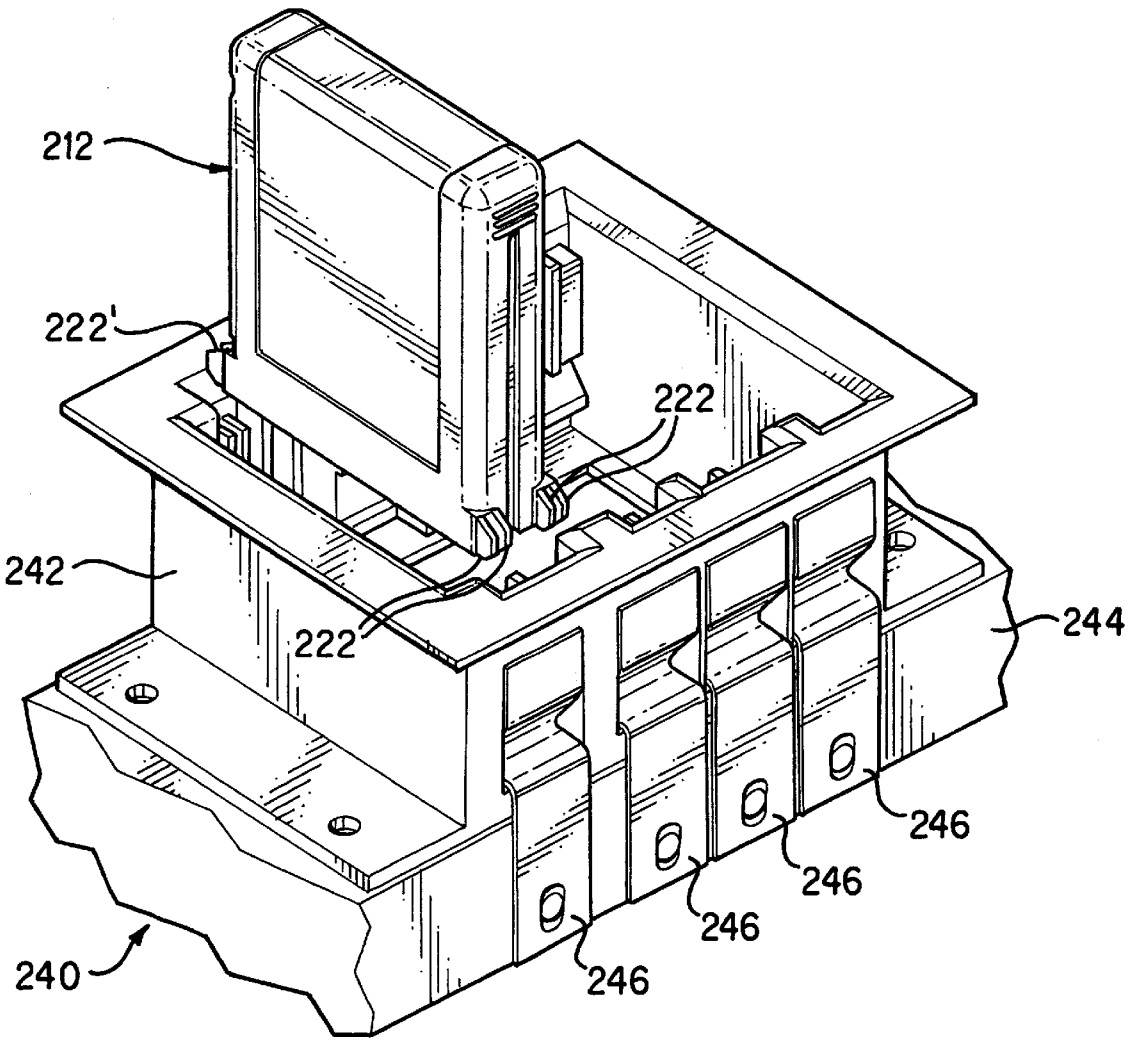
FIG. 10 is the ink container of FIG. 8 shown in engagement with the ink container receiving station of the present invention shown in partial cross section.
Figure 11C:
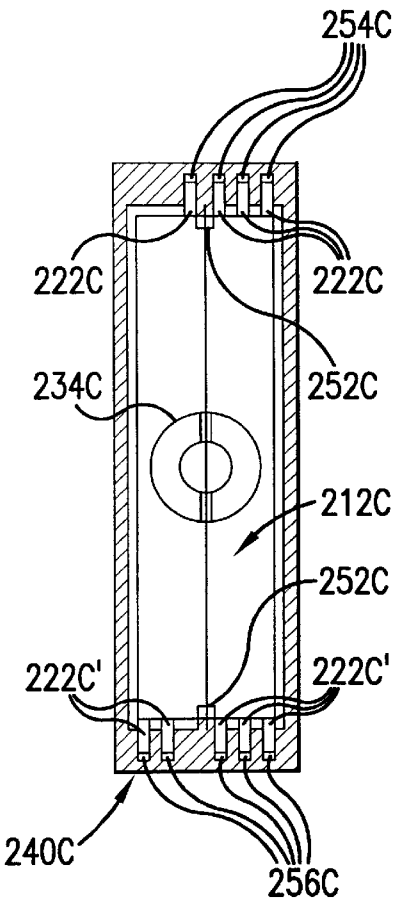
FIG. 11A–11G are bottom views of ink containers of FIG. 8 showing various latching and keying components of a preferred embodiment of the keying system of the present invention.
Figure 11B:
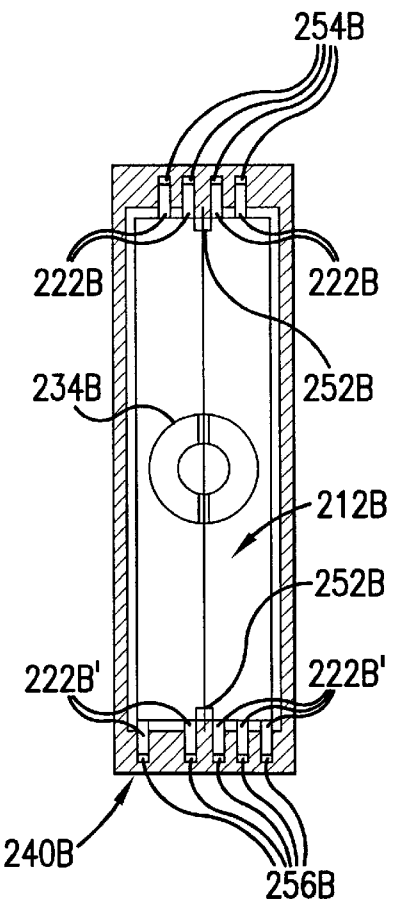
Figure 11A:
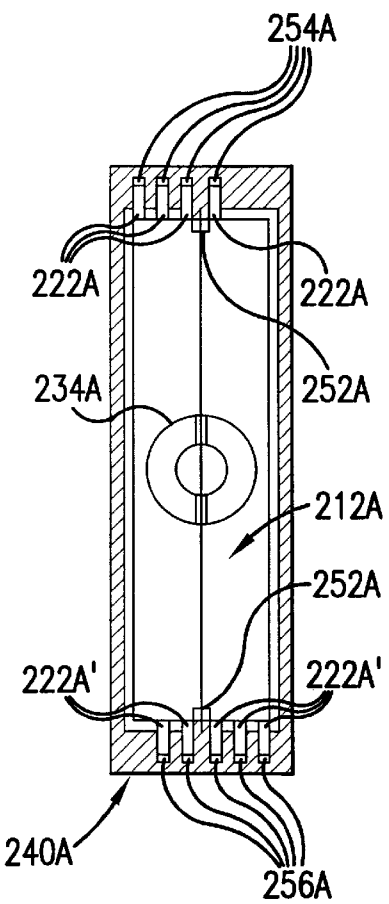
Figures 11D, 11E, 11F, 11G:
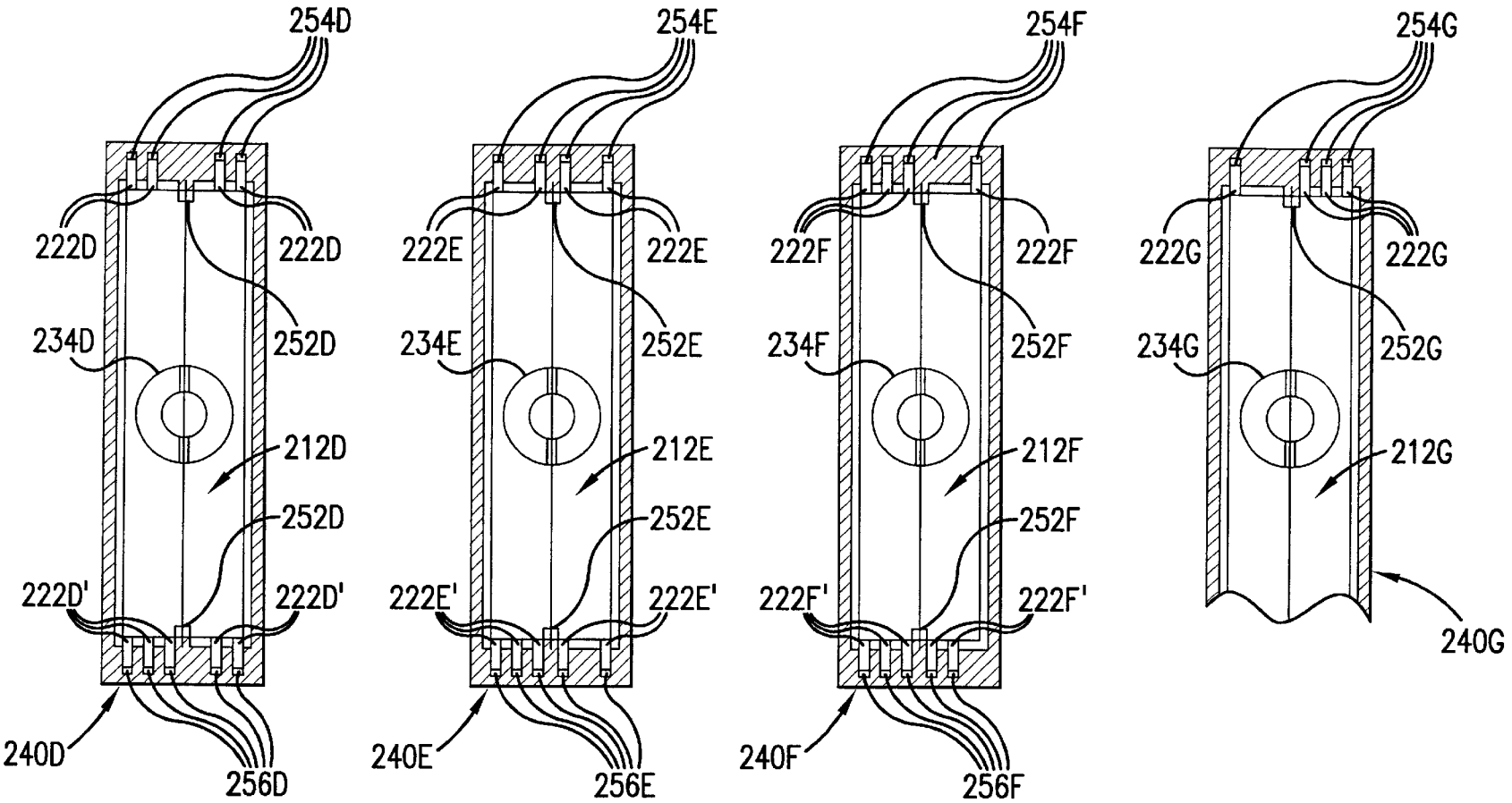

FIG. 10 shows the ink container 212 properly positioned in the ink container receiving station 240 such that latch members 246 engage each of the latch features 222 and 222' to securely hold the ink container 212 in position in the ink container receiving station 240. The ink container receiving station 240 together with the latch features 222 and 222' guide the ink container 212 during insertion into the printer to mechanically align the ink container 212 with the latch members 246 for securing the ink container 212 to the printer. The latch features 222 and 222' and the ink container receiving station 240 also provide a guiding and aligning function for ensuring proper electrical interconnection between the ink container 212 and the printer. This electrical interconnect allows the exchange of a variety of information between the ink container 212 and printer such as ink level information provided by an electrical sensor or additional ink parameter or ink container 212 information that is stored in a storage device associated with the ink container 212.

In the preferred embodiment the latch members 246 are spring clips which are shaped to engage each of the latch features 222 and 222' to hold the ink container 212 in position on the ink container receiving station 240. The latch members 246 have a non-latching position and a latching position. During insertion of the ink container 212, a non-latching surface 248 of the latch members 246 are urged by the latch features 222 and 222' into a non-latching position allowing the insertion of ink container 212. Once the ink container 212 is properly positioned in the ink container receiving station 240, as shown in FIG. 10, the latch members 246 spring back into a latching position whereupon a latching surface 250 of the latch members 246 engages the latch features 222 and 222' to secure the ink container 212 to the ink receiving station 240.

Tactile feedback is provided to the user as the ink container 212 is inserted into the ink receiving station 240 identifying the ink container 212 is properly positioned. Tactile feedback is provided by both the configuration of the latch members 246 as well as the configuration of the latch features 222 and 222'. As the ink container 212 is inserted, the latch members 246 provide a slight resistance as the non-engagement surfaces 248 engage the latch members 246 and urge the latch members 246 into the non-engagement position. Once the ink container 212 is properly positioned in the ink container receiving station 240, the engagement surfaces 250 engage the latch features 222 and 222' urging the ink container 212 towards the ink container receiving station 240 thereby providing tactile feedback to the user.

A pair of flanges 252 are formed on either side of the ink container receiving station 240. The pair of flanges 252 are configured to engage slots 238 which are defined in sidewalls of the ink container 212 to aid in guiding and aligning the ink container 212 during insertion into the ink container receiving station 240.

FIGS. 11A–G show ink containers 212A, 212B, 212C, 212D, 212E, 212F, and 212G each positioned within corresponding ink container receiving stations 240A, 240B, 240C, 240D, 240E, 240F, and 240G, respectively. Similar numbering is used in FIGS. 11A–G to represent features of FIGS. 8–10 that are similar. Each of the ink containers 212A–G have a unique arrangement of latch features 222A–G, and 222'A–G, respectively, which are indicative of different ink parameters of ink contained within each of the ink containers 212A–G. Each of the ink container receiving stations 240A–G include corresponding latch feature slots 254A–G which correspond to latch features 222A–G, respectively, and latch feature slots 256A–G which correspond to latch features 222'A–G, respectively.

The latch features 222A–G and 222'A–G together with corresponding latch feature slots 254A–G and 256A–G cooperate to ensure proper ink containers 212A–G are properly positioned in the ink container receiving station 240A–G. The ink containers 212A–G can only be inserted into ink container receiving stations 240A–G having corresponding latch feature slots 254A–G and 256A–G that are configured for that particular ink parameter. For example, the latch feature receiving slots 254B and 256B are configured to receive ink container 212B having ink parameters which are compatible. Ink containers 212A,C,D,E,F,G containing inks having non-compatible ink parameters cannot be inserted into the ink container receiving station 240B because the latch feature slots 254B and 256B do not correspond to the latch features 222A,C,D,E,F,G and 222'A, C,D,E,F,G.

In addition, the latch features 222A–G and 222'A–G together with corresponding latch feature slots 254A–G and 256A–G provide guiding and aligning features to ensure that the fluid interconnect 236 of the ink container 212 is properly aligned with the corresponding fluid interconnect on the printer. The fluid interconnect is mounted to the ink container 212A–G by the fitment receiving portion 234A–G, respectively.

An important feature of the latch features 222A,C,D,E, F,G and 222'A,C,D,E,F,G of the present invention is that in addition to the keying, guiding and aligning features previously discussed, these latch features are used in conjunction with the latch members 246 to secure the ink container 212 to the ink container receiving station 240.

In the preferred embodiment the latch features 222 and 222' are projecting tabs or keys which are evenly spaced. Each ink container 212 is initially manufactured to have an equal number of tabs or keys. The ink container 212 is then identified as having particular ink parameters by selectively removing tabs or keys to represent ink parameters contained therein. Alternatively, the ink containers may be initially formed having only the latch features or tabs required for the particular ink composition. By forming ink containers 212 to identify the ink parameter contained therein the step of selectively removing tabs or keys is eliminated.

The latch features 222 and 222' may be arranged in other locations on the ink container provided a suitable latching mechanism is provided on the ink container receiving station 240 to engage these latch features. It is preferable the latch features be toward a leading edge of the ink container 212 as the container is inserted into the receiving station 240 to provide guiding and alignment of the container 212 and also prevent the container from insertion to the extent that fluid connection is made prior to the keying function.

In conclusion, the present invention provides an ink container having a single set of features which perform latching, keying and aligning functions during the insertion of the ink container into an ink container receiving station. Integrating each of these functions into a single set of features reduces the complexity of molds used to form the ink container which reduces the manufacturing costs. In addition, the reduction of the latching, keying, and aligning features to a single integrated feature set tends to produce a cleaner more aesthetically pleasing container.

What is claimed is:

1. An ink supply container for containing ink, the ink supply container configured for providing ink to an ink jet printing system, the ink supply container including:

a first feature indicative of an ink family of a plurality of ink families associated with ink contained in the container, the first feature extending in a first direction; and a second feature different than and spaced from the first feature and extending in a second direction that is substantially opposite of the first direction, the second feature indicative of an ink color of a plurality of ink colors associated with ink in the container, wherein each of the first and second features are configured for engaging latch surfaces of the ink jet printing system for securely mounting the ink supply container to the ink jet printing system.

2. The ink supply container of claim 1 wherein the first feature comprises at least one keying portion that extends outwardly from the ink supply container and wherein the second feature comprises at least one keying portion that extends outwardly from the ink supply container.

3. The ink supply container of claim 1 further including a shell and a cap, the cap is attachable to the shell and wherein each of the first and second features are attached to the cap.

4. The ink supply container of claim 1 further comprising detent members formed in the shell adjacent to the first and second features.

5. The ink supply container of claim 1 wherein the ink family indicated by the first feature refers to particular physical properties of ink contained in the ink supply container.

6. The ink supply container of claim 5 wherein the particular physical properties of ink contained in the ink supply container is viscosity.

7. The ink supply container of claim 1 wherein the ink family indicated by the first feature refers to particular chemical properties of ink contained in the ink supply container.

8. The ink supply container of claim 7 wherein the particular chemical properties of ink contained in the ink supply container is solubility in water.

9. An ink supply container for containing ink, the ink supply container configured for providing ink to an ink jet printing system, the ink supply container including:

a first feature indicative of an ink family of a plurality of ink families associated with ink contained in the container, the first feature extending in a first direction;

a second feature spaced from the first feature and extending in a second direction that is substantially opposite of the first direction, the second feature indicative of an ink color of a plurality of ink colors associated with ink in the container;

a reservoir;

a variable volume chamber;

a valve interposed between the reservoir and the chamber to prevent the flow of ink from the chamber to the reservoir and allow the flow of ink from the reservoir to the chamber; and a fluid outlet for establishing a fluid connection between the chamber and the printing system when the ink supply container is placed in the printing system, the fluid outlet being closed to prevent the flow of ink from the chamber when the ink supply container is not within the printing system, whereby when the volume of the chamber is increased as ink is drawn from the reservoir through the valve and into the chamber and when the volume of the chamber is decreased ink is forced from the chamber through the fluid outlet.

10. A method of manufacturing an ink supply container to include features indicative of the type of ink contained in the container, the ink supply container configured for insertion into an ink jet printing system, the method comprising the steps of:

providing a cap;

forming on the cap a first feature at a predetermined location on the cap, wherein the location is indicative of a particular one type of ink;

forming on the cap a second feature indicative of a family of ink to be contained in the container;

providing a shell for containing a reservoir of ink, the shell lacking any perceptible indicia of the type of ink to be contained in the reservoir; and attaching the cap to a leading end of the shell, the leading end of the shell being that end of the shell first received by the printing system upon insertion of the ink supply container into the printing system.

11. The method of claim 10 wherein the attaching step includes covering a port, that is used for filling a reservoir of the shell, with the cap.

12. An ink container for supplying ink having proper ink parameters to an ink container receiving station having a latch surface, the ink container comprising:

a latch feature indicative of an ink parameter of a plurality of ink parameters, the latch feature being configured for engaging the latch surface of the ink container receiving station for securely mounting the ink container having proper ink parameters.

13. The ink container of claim 12 wherein the latch feature is a first and second latch feature and wherein the latch surface is a first and second latch surface with the first latch surface indicative of a first ink parameter and configured for engaging the first latch feature and the second latch surface indicative of a second ink parameter and configured for engaging the second latch feature.

14. The ink container of claim 13 wherein the first latch feature is different from the second latch feature.

15. The ink container of claim 13 wherein one of the first and second latch features are indicative of ink color associated with the ink container.

16. The ink container of claim 13 wherein one of the first and second latch features are indicative of ink compatibility associated with the ink container.

17. The ink container of claim 13 wherein the first latch feature is indicative of an ink color associated with the ink container and the second latching feature is indicative of an ink family associated with the ink container.

18. The ink container of claim 13 wherein each of the first and second latch features are a plurality of tabs extending from the ink container.

19. The ink container of claim 13 further including an ink container receiving station, the ink container receiving station including:

a first latching member configured for engaging corresponding ink container first latch features;

a second latching member configured for engaging corresponding ink container second latch features; and a keying system component attached to the ink container receiving station to define, in conjunction with the first and second latch features, ink containers having proper ink parameters.

20. The ink container of claim 19 wherein the ink container receiving station is attached to an ink jet printer and ink provided by the ink container is utilized by the ink jet printer to form images on media.

21. An ink container receiving station for receiving ink containers having proper ink parameters, the ink container receiving station comprising:

a first latching member configured for engaging corresponding ink container first latch features disposed at ink container leading ends first received by the ink container receiving station;

a second latching member configured for engaging corresponding ink container second latch features disposed at the ink container leading ends first received by the ink container receiving station; and a keying system component attached to the ink container receiving station to define, in conjunction with the first and second latch features ink containers having proper ink parameters.

22. The ink container receiving station for receiving ink containers of claim 21 wherein each of the first and second latching members are a spring clip.

23. The ink container receiving station for receiving ink containers of claim 21 wherein the keying system is a plurality of key slots for accepting ink containers having proper latch features.

24. A method for forming an ink container indicative of an ink parameter from a plurality of ink parameters, the method comprising:

forming first and second identical ink container portions, each ink container portion having a plurality of latch features;

assembling the ink container portions to form the ink container;

removing at least one of the plurality of latch features to form a non-symmetric ink container indicative of a selected ink parameter from a plurality of ink parameters.

25. A system for locating an ink container in an ink based printing device, the system comprising:

a plurality of ink containers, each of the plurality of ink containers having a plurality of latching features indicative of an ink parameter;

keying components integrated into the ink based printing device to guide the insertion of ink containers having corresponding latching features and to restrict the insertion of ink containers having latching features which correspond to non-compatible ink parameters; and a latching mechanism configured for engaging the plurality of latching features for securing ink containers corresponding to keying components to the ink based printing device.

26. An ink container for use with a system of locating ink containers in an ink based printing device, the ink based printing device of the type having an ink container receiving station for receiving ink containers, the ink container comprising:

a latch feature configured for engaging ink container receiving station latch features, the ink container latch features being indicative of an ink parameter of a plurality of ink parameters;

a fluid interconnect attached to the ink container with only ink containers having ink parameters compatible with corresponding ink container receiving station ink parameters being configured for insertion wherein the latch feature received by corresponding ink container receiving station latch feature slots align the fluid interconnect with corresponding ink container receiving station fluid interconnects, with the ink container properly positioned in ink container receiving stations the latch feature is engaged by corresponding ink container receiving station latch features securing the ink container thereby establishing reliable inflow between the ink container and ink based printing devices.

* * * * *